US005195876A

United States Patent [19]

Hansen

[11] Patent Number: 5,195,876

[45] Date of Patent: Mar. 23, 1993

[54] PLUNGER PUMP

[75] Inventor: Peter N. Hansen, Dallas, Tex.

[73] Assignee: Baker Hughes Incorporated, Houston, Tex.

[21] Appl. No.: 684,586

[22] Filed: Apr. 12, 1991

[51] Int. Cl.[5] ..... F04B 21/02

[52] U.S. Cl. ..... 417/307; 417/435; 417/454; 137/539

[58] Field of Search ..... 417/435, 454, 307, 559; 137/539, 539.5, 454.4, 454.5

[56] References Cited

U.S. PATENT DOCUMENTS

| | | | |
|---|---|---|---|
| 1,166,224 | 12/1915 | Kimes | 417/435 |
| 2,405,466 | 8/1946 | Tabb | 417/307 |
| 2,998,827 | 9/1961 | Cook et al. | 137/539.5 |
| 3,726,612 | 4/1973 | Greene, Jr. | 417/454 |
| 3,746,476 | 7/1973 | Bradley | 417/269 |
| 3,801,234 | 4/1974 | Love et al. . | |
| 4,269,572 | 5/1981 | Nozawa et al. . | |
| 4,477,237 | 10/1984 | Grable . | |
| 4,618,316 | 10/1986 | Elliott et al. . | |
| 4,778,347 | 10/1988 | Mize . | |
| 4,854,835 | 8/1989 | Onishi | 417/435 |
| 4,911,405 | 3/1990 | Weissgerber | 417/505 |
| 4,977,927 | 12/1990 | Hill | 137/539 |

FOREIGN PATENT DOCUMENTS

| | | | |
|---|---|---|---|
| 228018 | 6/1963 | Austria | 137/454.5 |
| 2363044 | 3/1978 | France | 137/539 |

*Primary Examiner*—Leonard E. Smith
*Attorney, Agent, or Firm*—Rosenblatt & Assoc.

[57] ABSTRACT

The invention consists of a liquid end for a plunger pump, having vertical inlet and outlet, with the suction and discharge valves readily accessible for maintenance without disturbing the suction and discharge piping. The liquid end also includes a relief valve which is accessible without disturbing suction or discharge piping. The passages to and from the relief valve are internal to the housing. Inserts are provided in the valves to eliminate dead space and to facilitate the removal of any trapped air which might adversely affect the performance of the pump.

18 Claims, 2 Drawing Sheets

PLUNGER PUMP

FIELD OF THE INVENTION

The field of this invention is plunger pumps, specifically those capable of handling viscous fluids.

BACKGROUND OF THE INVENTION

Plunger pumps have been used for a wide variety of metering applications, particularly those involving low flow rates. The volumetric delivery of such pumps can be affected by various factors. The presumed volume delivered by such pumps is calculated based on the displacement per revolution. However, if the cylinder does not fill completely and efficiently during the intake stroke, the precise amount delivered is not capable of accurate measurement.

Some liquids are so viscous that a booster force must be applied to the liquid in its storage container in order to move the material through the suction lines and into the cylinder.

Due to the wide variety of liquids that are pumped through plunger pumps, further inaccuracies can result if the material has varying physical properties with temperature, which may affect its viscosity, and if the material is compressible to any degree.

Dead spots are particularly undesirable in the construction of plunger pumps since vapors such as air may accumulate in those dead spots which, depending upon the volume, may prevent the pump from pumping at all. In some designs, the dead volume substantially exceeds the total displacement volume and this can prevent the pump from purging itself while it is operating.

Frequently, when it is time to maintain such pumps, the piping must be disconnected from the pump body so that work can commence on renewing or replacing the check valves. The check valves are a part that requires more frequent maintenance among the various pump parts. Several known designs incorporate the check valves in a manner that requires disassembly of the suction and discharge piping to obtain access for maintenance. Typical of such plunger pump designs are U.S. Pat. Nos. 3,801,234; 4,854,835; 4,269,572. Other references address the issue of the need to remove the valves easily but provide fairly complicated solutions for their removal. Such patents include U.S. Pat. No. 4,618,316. Yet other designs feature complicated internal passages among various cylinders, such as U.S. Pat. No. 3,746,476. Yet other designs still require disassembly of the suction and/or discharge piping for full and ready access to the complete suction and/or discharge valve assemblies or for maintenance of the relief valve. Typical of such patents are U.S. Pat. Nos. 4,477,237 and 4,778,347.

The apparatus of the present invention seeks to provide a design for a plunger pump wherein the suction and discharge valves are easily accessible without disassembly of piping. The design further seeks to embody a built-in relief valve which is easily accessible without removal of any piping and which is fully internally ported from the discharge piping to the suction piping. The design further seeks to eliminate as much as possible any dead spots and to provide a means for elimination of air which may be trapped in such dead spots which could possibly prevent the pump from pumping.

SUMMARY OF THE INVENTION

The invention consists of a liquid end for a plunger pump, having vertical inlet and outlet, with the suction and discharge valves readily accessible for maintenance without disturbing the suction and discharge piping. The liquid end also includes a relief valve which is accessible without disturbing suction or discharge piping. The passages to and from the relief valve are internal to the housing. Inserts are provided in the valves to eliminate dead space and to facilitate the removal of any trapped air which might adversely affect the performance of the pump.

DETAILED DESCRIPTION OF THE PREFERRED EMBODIMENT

Many applications in chemical processing and fluid treatment require the addition of fluids at a very small rate. There have been applications involving additions of chemicals to pipelines to reduce frictional losses which in turn allow for increased throughput with existing equipment. Chemicals that have been injected into pipelines to reduce frictional losses have typically been injected at very low rates such as, for example, 3–4 gallons per hour for pipelines of approximately 8" in size and approximately 3600 gallons per day for larger pipelines, such as up to 36". Many of these injection fluids are expensive and require careful metering to optimize operations, as well as economics. Many of the materials that need to be metered at low rates are often very viscous materials, having viscosities in the range of one million centistokes and higher. These materials do not flow readily, can be slightly compressible, and have physical properties that vary with temperature.

When using plunger pumps to deliver such materials, the amount of delivery of such pumps is calculated based on the displacement. Inaccuracies have arisen when the cylinders have failed to fill on each stroke due to pockets of gas in dead spots in such pumps or the material simply has not filled the cylinders due to its viscous nature. Additionally, in designs that require significant motion for the valves prior to seating, there could exist a situation involving leakage where the fluid is displaced through the suction valve which has yet to seat instead of out into the discharge line. Alternatively, leakage by the discharge valve on the suction portion of the stroke can also reduce the pump output. This type of leakage reduces the efficiency of the pump and creates uncertainties as to the volume pumped.

Figure 1:
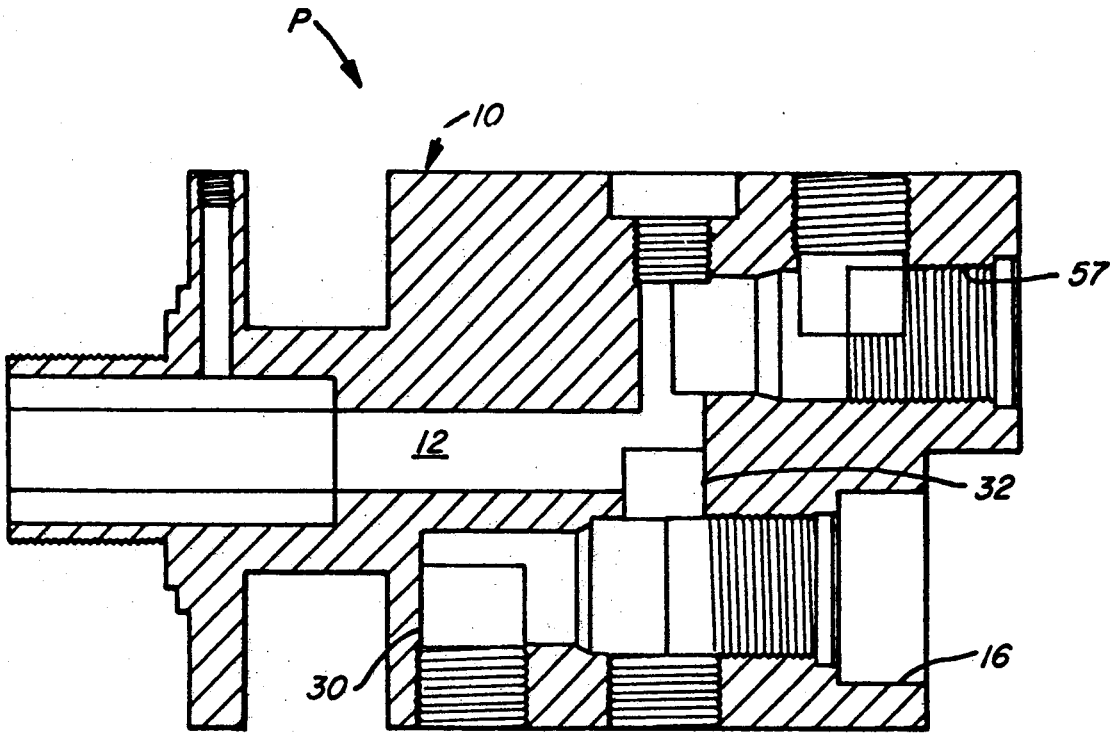
FIG. 1 is a sectional view through the pump housing, showing the positioning of the suction and discharge valves.
Figure 3:
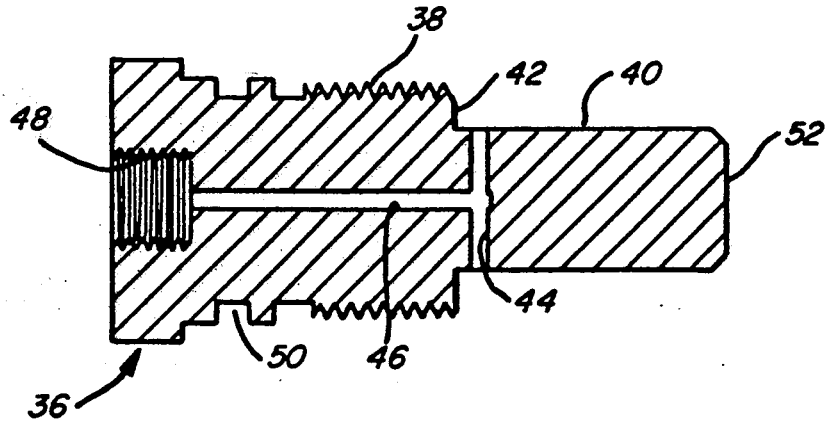
FIG. 3 shows the insert which can be mounted to the suction and discharge check valves to facilitate removal of trapped air.

The plunger pump P is shown in section view in FIG. 1. It has a body 10. A plunger (not shown) reciprocates in passage 12. The inlet piping (not shown) is connected to what is market "inlet." The suction check valve assembly 14 (see FIG. 2) is inserted in opening 16 in body 10. Threads 18 connect the check valve assembly 14 to the housing 10.

Figure 2:
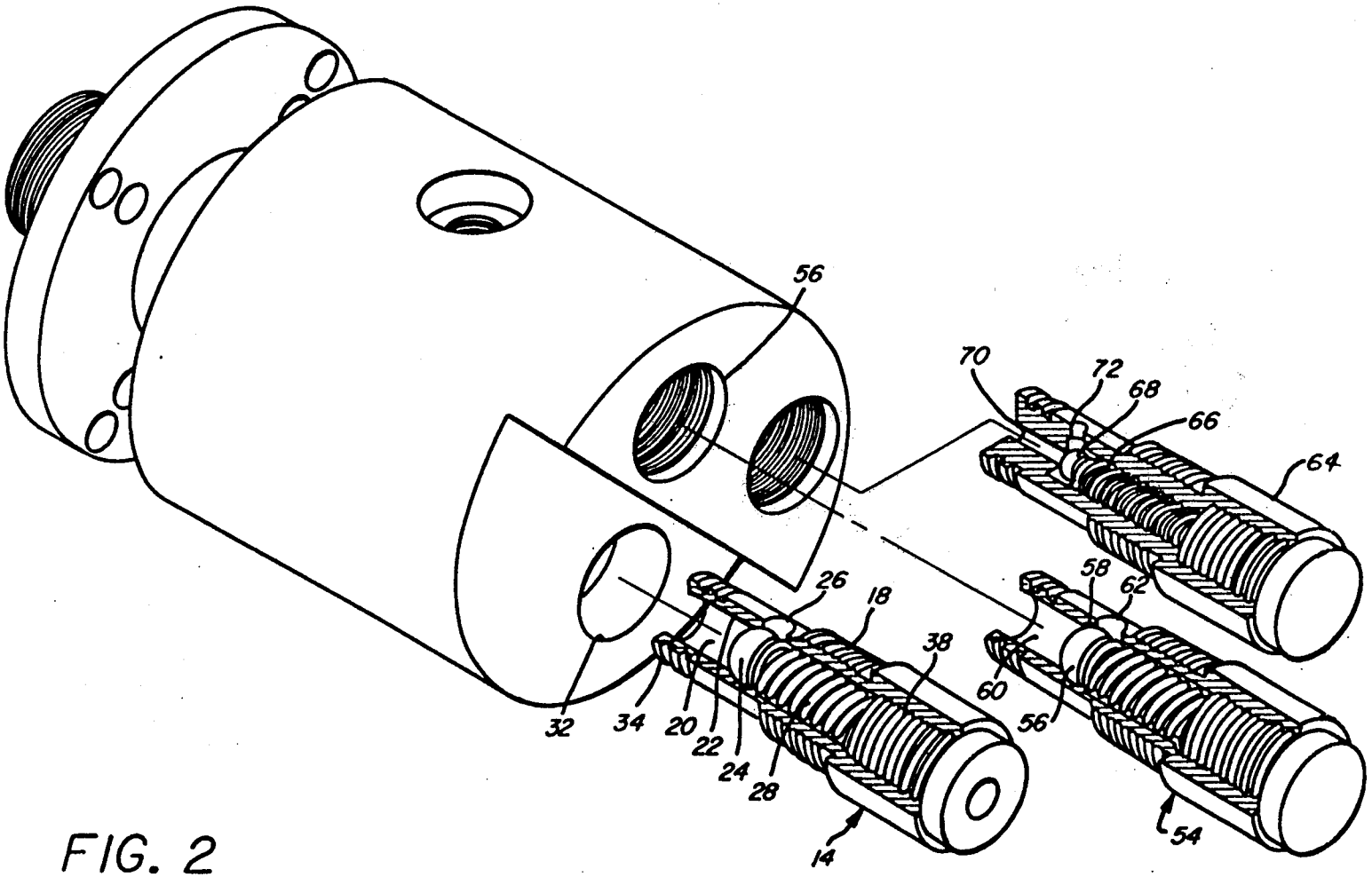
FIG. 2 is an exploded view, showing the placement of the suction and discharge check valves and the relief valve in the housing.

Referring now to FIG. 2, the inlet check valve assembly 14 has a suction opening 20, a seat 22, a ball 24, an opening 26 (in fluid communication with bore 32), and a spring 28. Spring 28 bears on ball 24, pushing it against seat 22, isolating passage 30 from bore 32. Grooves 34 accommodate seals (not shown) which engage passage 30 to seal around the outer periphery of check valve assembly 14. When the plunger (not shown) moves in its suction stroke away from bore 32, ball 24 is urged against spring 28 due to opening 26 being closer to bore 32 than seat 22, allowing suction opening 20 to come into fluid communication with outlet 26, thereby permitting flow from the inlet into bore 32. Disposed within the suction check valve assembly 14 is insert 36. Insert 36 has threads 38 which secure insert 36 to check valve assembly 14. Insert 36 has a front portion or nose 40, with spring 28 circumscribing nose 40 and resting on radial surface 42. Lateral passage 44 connects to longitudinal passage 46, which ends in threaded connection 48. Grooves 50 contain seals (not shown) to seal between insert 36 and check valve assembly 14. Referring now to FIG. 2, it can be seen that by virtue of the use of nose 40, the total range of movement of ball 24 is limited, thereby decreasing the amount of dead space in the suction piping. The ball is allowed to travel back only a sufficient distance to clear opening 26, which occurs at the time that it bumps into surface 52 on nose 40. The passages 44 and 46, in combination with a plug or valve inserted into threads 48, allow for removal of any accumulated vapors which could ultimately decrease the efficiency of the pump and/or its ability to pump altogether. When necessary to remove accumulated vapors, a plug (not shown) is removed from threads 48 or a valve (not shown) which had previously been connected to threads 48 is opened to allow such vapor to be removed.

The discharge valve assembly 54 is disposed in opening 57 and in all respects operates in a similar manner as suction check valve 14 except that it is reverse acting with respect to the operation of suction check valve 14. When the piston (not shown) strokes in passage 12 for the discharge portion of the stroke, the increasing pressure in bore 32 forces the ball 56 away from seat 58, permitting fluid communication from passage 60 to passage 62.

The relief valve assembly 64 functions in the same manner as suction check valve assembly 14 and discharge check valve assembly 54. The difference is that the relief valve assembly 64 has a stiffer spring 66 than the springs in the suction and discharge valve assemblies 14 and 54, respectively. When the pressure within the outlet (see FIG. 1) rises above a preset amount, ball 68 is displaced, allowing fluid communication between passages 70 and 72. When the pressure in bore 32 is subsequently reduced below a preset amount, ball 68 reseats, closing off passage 72 from passage 70. Passage 70 is internally connected within housing 10 to the outlet, as labeled on FIG. 1. Passage 72 is internally connected within housing 10 to the inlet, as labeled on FIG. 1.

To further aid in removal of accumulated air within bore 32, FIG. 1 indicates a plug mounted in opening 16 and a outlet from passage 57, labeled "bleed" on FIG. 1. These two access passages, labeled "plug" and "bleed," are preferably in alignment and give full access to bore 32. The outlet, labeled "bleed," provides a high point vent in the housing 10 to allow trapped vapors to escape. The outlet, labeled "plug," facilitates draining and cleaning of the pump after use and prior to maintenance.

Since the fluids that must be pumped by the apparatus of the present invention are frequently viscous and messy, it is desirable to have the assembly as illustrated in the figures to facilitate maintenance work on suction, discharge, and relief valves. As can be seen from FIG. 2, the suction and discharge piping connected to the body 10 need not be disturbed when removing and reinserting the suction, discharge, or relief valves.

The use of insert 36 within suction and discharge check valve assemblies 14 and 54, respectively, and in relief valve assembly 64 reduces dead space so that the dead volume in the apparatus of the present invention approaches the total displacement volume, thereby allowing the pump to purge itself of any air found within the housing 10. Typically, the ratio of dead volume to total displacement is less than 1.1:1.

The relative short range of motion for balls 24 and 56 promotes rapid reseating to prevent significant amounts of leakage through ball 24 on the discharge stroke and ball 56 on the intake stroke. The use of nose 40 also significantly reduces the volume of dead space in the pump P of the present invention, facilitating its ability to purge itself of any accumulated air. This is an advantageous feature over prior designs which could have dead volume in excess of two times the displacement volume, making it difficult for such designs to purge themselves of unwanted trapped air.

The pump of the present invention has particular application in injection of polymer gel into pipelines to reduce flow resistance.

The housing 10 can be separately provided from a driver unit which has a plunger extending therefrom to facilitate quick substitution of housings 10 in the event maintenance or repair is required in order to minimize downtime of the pumping system.

The foregoing disclosure and description of the invention are illustrative and explanatory thereof, and various changes in the size, shape and materials, as well as in the details of the illustrated construction, may be made without departing from the spirit of the invention.

I claim:

1. A plunger pump, comprising:

a housing;

an inlet and outlet on said housing;

a passage connecting said inlet and outlet defining a bore;

a plunger mounted in said housing for inward and outward movement to vary the volume of said bore;

a suction check valve assembly in said housing selectively sealing off said inlet from said bore and removably mounted to said housing at a point removed from said inlet;

a discharge check valve assembly in said housing selectively sealing off said outlet from said bore and removably mounted to said housing at a point removed from said outlet;

vent means to allow purging of trapped fluid from said bore;

said vent means extends through at least one of said suction and discharge valve assemblies.

2. A plunger pump, comprising:

a housing;

an inlet and outlet on said housing;

a passage connecting said inlet and outlet defining a bore;

a plunger mounted in said housing for inward and outward movement to vary the volume of said bore;

a suction check valve assembly in said housing selectively sealing off said inlet from said bore and removably mounted to said housing at a point removed from said inlet;

a discharge check valve assembly in said housing selectively sealing off said outlet from said bore and removably mounted to said housing at a point removed from said outlet;

insert means in at least one of said inlet and outlet check valve assemblies to reduce dead space therein; and vent means extending through said insert means to outside of said housing to facilitate selective purging of trapped gas therefrom.

3. A plunger pump, comprising:

a housing;

an inlet and outlet on said housing;

a passage connecting said inlet and outlet defining a bore;

a plunger mounted in said housing for inward and outward movement to vary the volume of said bore;

a suction check valve assembly in said housing selectively sealing off said inlet from said bore and removably mounted to said housing at a point removed from said inlet;

a discharge check valve assembly in said housing selectively sealing off said outlet from said bore and removably mounted to said housing at a point removed from said outlet;

a relief valve mounted in said housing to relieve over pressure at said outlet by selective alignment of said outlet to said inlet within said housing;

vent means to allow purging of trapped fluid from said bore;

said vent means extends through said suction check valve assembly.

4. The pump of claim 3, wherein:

the ratio of the smallest volume between said inlet and outlet check valve assemblies as said plunger moves inward fully and the volume displaced by said plunger between maximum inward and outward movement is less than about 1.1:1.

5. The pump of claim 3, further comprising:

insert means in said inlet check valve assembly to reduce dead space therein;

said vent means extending through said insert means to outside of said housing to facilitate selective purging of trapped gas therefrom.

6. The pump of claim 5, wherein said check valve assemblies each further comprise:

a seat;

a sealing element movable between an open and closed position;

biasing means urging said sealing element against said seat;

said insert means further comprises:

a nose acting as a travel stop to said sealing element in its open position;

said biasing means circumscribing said nose, thereby reducing dead space in said passage.

7. The pump of claim 6, wherein said vent means further comprises:

a flowpath extending from said nose to outside the housing on at least one of said inserts.

8. The pump of claim 7, wherein:

the ratio of the smallest volume between said inlet and outlet check valve assemblies as said plunger moves inward fully and the volume displaced by said plunger between maximum inward and outward movement is less than about 1.1:1.

9. A check valve assembly for use in a plunger pump, comprising:

an elongated housing;

a seat;

a movable valve member operable between an open and a closed position;

biasing means urging the valve member into its closed position in contact with said seat;

insert means in said housing for reducing internal volume therein;

vent means extending through said insert means and accessable to one end of said housing.

10. The pump of claim 9, wherein:

the ratio of the smallest volume between said inlet and outlet check valve assemblies as said plunger moves inward fully and the volume displaced by said plunger between maximum inward and outward movement is less than about 1.1:1.

11. The check valve of claim 9, wherein said insert means further comprises:

an elongated solid member mounted in said housing;

said vent means comprising a flowpath through said elongated member.

12. The check valve of claim 11, wherein:

said biasing means is a spring;

said elongated member has a reduced cross-sectional segment creating a shoulder, and an elongated gap along said housing;

said spring bearing on said shoulder and extending into said gap.

13. The check valve of claim 12, wherein:

said elongated member acts as a travel stop to said valve member in its open position; and said flowpath extends from said nose through the opposite end of said member and is accessible through an end of said housing.

14. A plunger pump having at least one plunger reciprocating in at least one bore and at least one inlet and outlet check valve, comprising:

a pump housing having an inlet and an outlet adapted to be connected to a piping network;

a relief valve mounted in said pump housing at a point removed from said inlet and outlet;

internal flowpaths in said pump housing to connect said relief valve to said inlet and outlet;

at least one valve asembly further comprising:

an elongated valve housing:

a seat;

a movable valve member operable between an open and a closed position;

biasing means urging the valve member into its closed position in contact with said seat;

insert means in said valve housing for reducing internal volume therein; and vent means extending through said insert means and accessible to one end of said valve housing.

15. The pump of claim 14, wherein:

the ratio of the smallest volume between said inlet and outlet check valve assemblies as said plunger moves inward fully and the volume displaced by said plunger between maximum inward and outward movement is less than about 1.1:1.

16. The pump of claim 14, wherein said insert means further comprises:

an elongated solid member mounted in said housing;

said vent means comprising a flowpath through said elongated member.

17. The pump of claim 16, wherein:

said biasing means is a spring;

said elongated member has a reduced cross-sectional segment creating a shoulder, and an elongated gap along said housing;

said spring bearing on said shoulder and extending into said gap.

18. The pump of claim 17, wherein:

said elongated member acts as a travel stop to said valve member in its open position; and said flowpath extends from said nose through the opposite end of said member and is accessible through an end of said housing.

* * * * *